US006863283B1

(12) United States Patent
Houston et al.

(10) Patent No.: US 6,863,283 B1
(45) Date of Patent: Mar. 8, 2005

(54) SHOCK ABSORBING QUAD AND INLINE ROLLER SKATES

(76) Inventors: Arnold W. Houston, 7508 Elizabeth Rd., Vacaville, CA (US) 95688; Danielle Neuner, 7508 Elizabeth Rd., Vacaville, CA (US) 95688

( * ) Notice: Subject to any disclaimer, the term of this patent is extended or adjusted under 35 U.S.C. 154(b) by 54 days.

(21) Appl. No.: 10/259,932

(22) Filed: Sep. 27, 2002

(51) Int. Cl.[7] ..... A63C 17/02
(52) U.S. Cl. ..... 280/11.225; 280/11.28
(58) Field of Search ..... 280/11.204, 11.207, 280/11.225, 11.27, 11.28

(56) References Cited

U.S. PATENT DOCUMENTS

| | | | | | |
|---|---|---|---|---|---|
| 301,522 | A | * | 7/1884 | Richardson | 280/11.28 |
| 319,839 | A | * | 6/1885 | Nelson | 280/11.28 |
| 619,370 | A | * | 2/1899 | Wagner | 280/11.115 |
| 1,018,512 | A | * | 2/1912 | Mess | 280/11.28 |
| 1,603,529 | A | * | 10/1926 | Faust | 280/11.19 |
| 1,609,612 | A | * | 12/1926 | Eskeland | 280/11.223 |
| 2,195,348 | A | * | 3/1940 | Wiseley | 280/11.26 |
| 2,557,331 | A | * | 6/1951 | Wintercorn | 280/11.28 |
| 2,572,133 | A | * | 10/1951 | Glenn | 280/11.28 |
| 4,294,455 | A | * | 10/1981 | Krueger | 280/11.209 |
| 4,817,974 | A | * | 4/1989 | Bergeron | 280/11.209 |
| D301,908 | S | | 6/1989 | Olson et al. | |
| 4,915,399 | A | * | 4/1990 | Marandel | 280/11.28 |
| 5,029,882 | A | | 7/1991 | Marandel | |
| 5,114,166 | A | * | 5/1992 | McCosker | 280/87.042 |
| 5,263,725 | A | * | 11/1993 | Gesmer et al. | 280/11.28 |
| 5,411,277 | A | | 5/1995 | Pratt | |
| 5,524,911 | A | | 6/1996 | Cochimin | |
| 5,630,891 | A | | 5/1997 | Peterson et al. | |
| 5,714,100 | A | | 2/1998 | Jou | |
| 5,716,060 | A | * | 2/1998 | Szendel | 280/11.223 |
| D396,516 | S | | 7/1998 | Fung | |
| 5,918,889 | A | * | 7/1999 | Tai | 280/11.225 |
| 5,954,348 | A | * | 9/1999 | Santarsiero et al. | 280/11.201 |
| 5,961,132 | A | * | 10/1999 | Post | 280/11.223 |
| 5,997,018 | A | * | 12/1999 | Lee | 280/87.042 |
| 6,224,076 | B1 | * | 5/2001 | Kent | 280/87.042 |
| 6,241,264 | B1 | * | 6/2001 | Page | 280/11.19 |
| 6,539,994 | B1 | * | 4/2003 | Ruffa | 152/157 |

* cited by examiner

*Primary Examiner*—Christopher P. Ellis
*Assistant Examiner*—Christopher Bottorff

(57) ABSTRACT

Shock absorbing quad and inline roller skates for use in traversing across rugged off-road terrain. The shock absorbing quad and inline roller skates includes a boot that has a foam-lining cushion for user comfort. A plurality of wheels that have an outer inflatable tire portion that is made of a puncture resistance material and a system for coupling the boot to the wheels with a plurality of shock absorbers.

1 Claim, 4 Drawing Sheets

SHOCK ABSORBING QUAD AND INLINE ROLLER SKATES

BACKGROUND OF THE INVENTION

1. Field of the Invention

The present invention relates to roller skates and more particularly pertains to new shock absorbing quad and inline roller skates for use in traversing across rugged off-road terrain.

2. Description of the Prior Art

The use of roller skates is known in the prior art. More specifically, roller skates heretofore devised and utilized are known to consist basically of familiar, expected and obvious structural configurations, notwithstanding the myriad of designs encompassed by the crowded prior art that have been developed for the fulfillment of countless objectives and requirements.

Known prior art includes U.S. Pat. No. 5,029,882; U.S. Pat. No. 5,524,911; U.S. Pat. No. 301,908; U.S. Pat. No. 396,516; U.S. Pat. No. 5,714,100; U.S. Pat. No. 5,411,277 and U.S. Pat. No. 5,630,891.

While these devices fulfill their respective, particular objectifies and requirements, the aforementioned patents do not disclose a new extreme inline and quad off road skates. The inventive device includes a boot that has a foam-lining cushion for user comfort. A plurality of wheels that have an outer inflatable tire portion that is made of a puncture resistance material and a means for coupling the boot to the wheels with a plurality of shock absorbers.

In these respects, the shock absorbing quad and inline roller skates according to the present invention substantially departs from the conventional concepts and designs of the prior art, and in so doing provides an apparatus primarily developed for the purpose of use in traversing across rugged off-road terrain.

SUMMARY OF THE INVENTION

In view of the foregoing disadvantages inherent in the known types of roller skates now present in the prior art, the present invention provides a new shock absorbing quad and inline roller skate construction wherein the same can be utilized for use in traversing across rugged off-road terrain.

The general purpose of the present invention, which will be described subsequently in greater detail, is to provide a new shock absorbing quad and inline roller skates apparatus and method which has many of the advantages of the roller skates mentioned heretofore and many novel features that result in a new shock absorbing quad and inline roller skates which is not anticipated, rendered obvious, suggested, or even implied by any of the prior art roller skates, either alone or in any combination thereof.

To attain this, the present invention generally comprises a boot that has a foam-lining cushion for user comfort. A plurality of wheels that have an outer inflatable tire portion that is made of a puncture resistance material and a means for coupling the boot to the wheels with a plurality of shock absorbers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shock absorbing quad and inline roller skate apparatus and method which has many of the advantages of the roller skates mentioned heretofore and many novel features that result in a new shock absorbing quad and inline roller skate which is not anticipated, rendered obvious, suggested, or even implied by any of the prior art roller skates, either alone or in any combination thereof.

It is another object of the present invention to provide new shock absorbing quad and inline roller skates that may be easily and efficiently manufactured and marketed.

It is a further object of the present invention to provide new shock absorbing quad and inline roller skate that are of a durable and reliable construction.

An even further object of the present invention is to provide new shock absorbing quad and inline roller skates which are susceptible of a low cost of manufacture with regard to both materials and labor, and which accordingly is then susceptible of low prices of sale to the consuming public, thereby making such shock absorbing quad and inline roller skates economically available to the buying public.

Still yet another object of the present invention is to provide new shock absorbing quad and inline roller skates that provides in the apparatuses and methods of the prior art some of the advantages thereof, while simultaneously overcoming some of the disadvantages normally associated therewith.

Still another object of the present invention is to provide a new shock absorbing quad and inline roller skates for use in traversing across rugged off-road terrain.

Yet another object of the present invention is to provide a new shock absorbing quad and inline roller skate that includes a boot that has a foam-lining cushion for user comfort. A plurality of wheels that have an outer inflatable tire portion that is made of a puncture resistance material and a means for coupling the boot to the wheels with a plurality of shock absorbers.

Still yet another object of the present invention is to provide new shock absorbing quad and inline roller skates that will allow a user to skate even if they are restricted from using paved areas like sidewalks and roads.

Even still another object of the present invention is to provide new shock absorbing quad and inline roller skates that are full to use.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
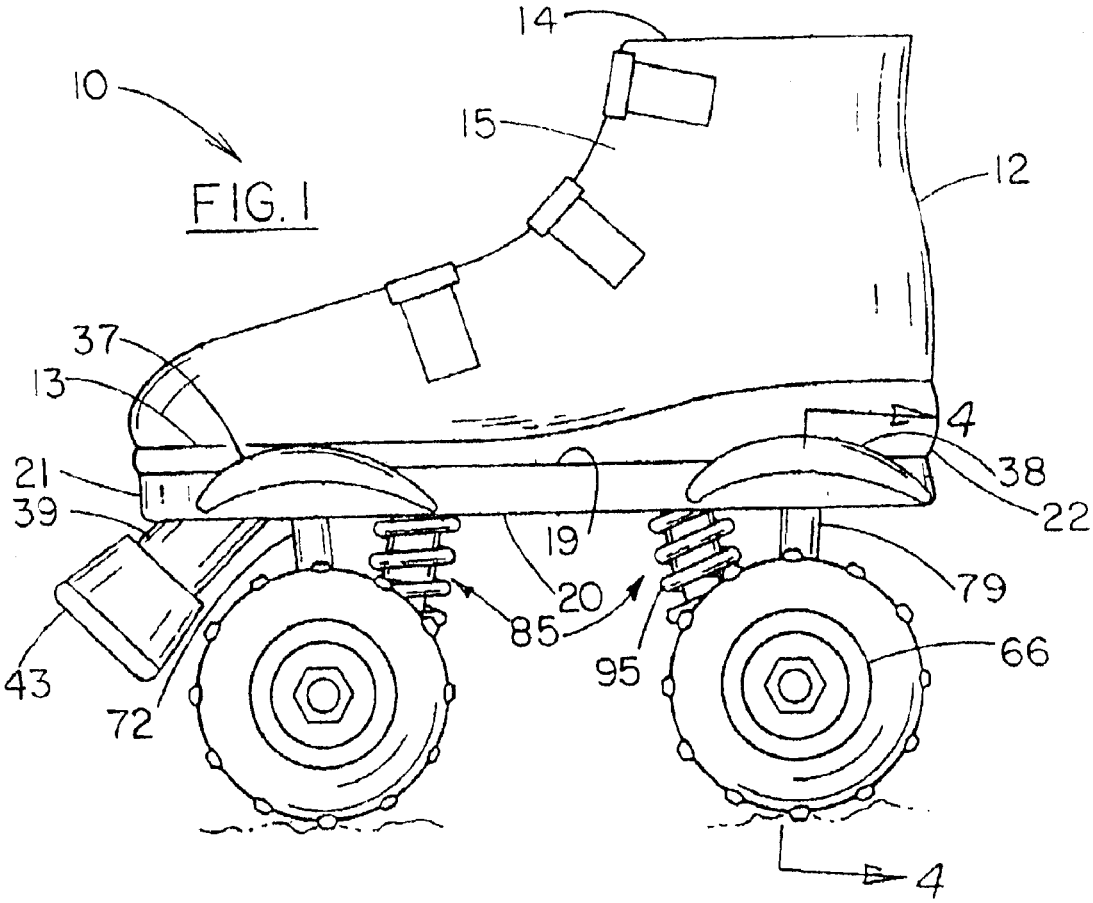
FIG. 1 is a schematic side view of a new shock absorbing quad roller skates according to the present invention.
Figure 2:
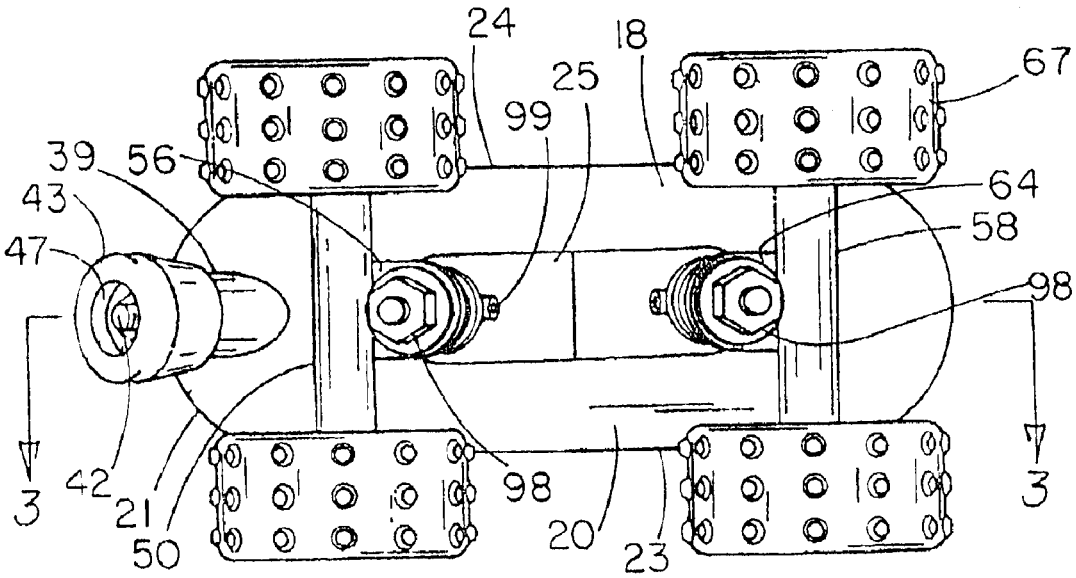
FIG. 2 is a schematic bottom view of a new shock absorbing quad roller skate according to the present invention.
Figure 3:
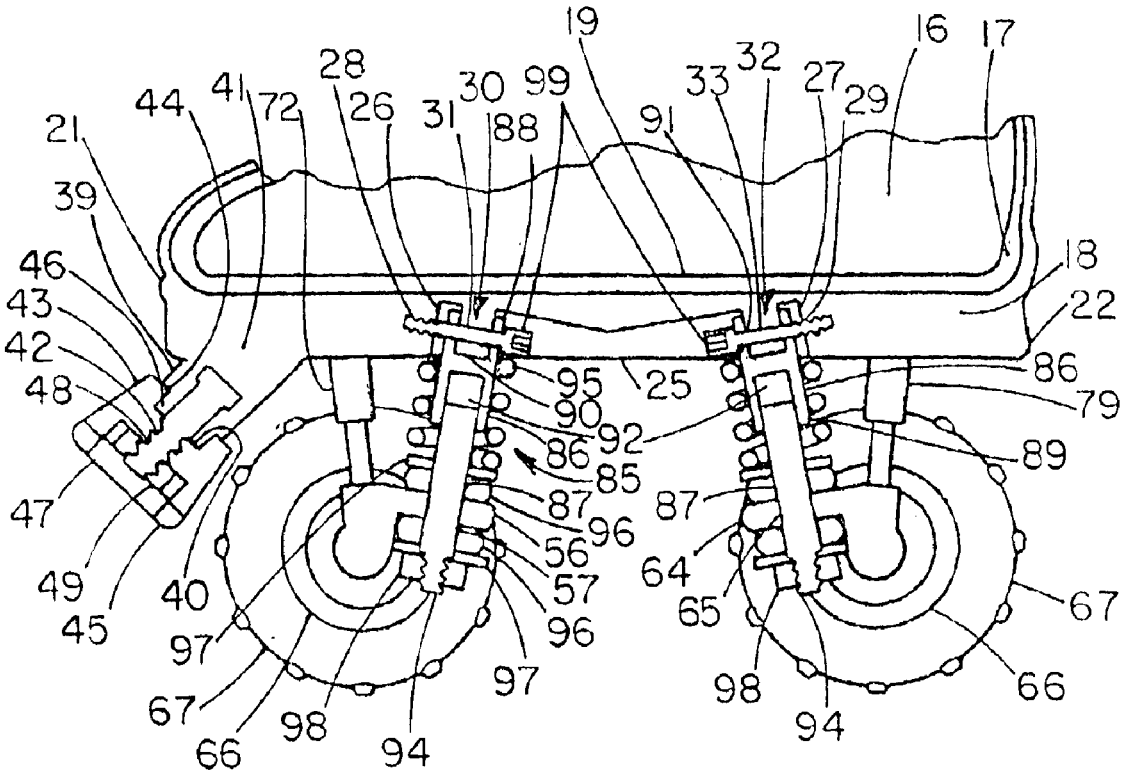
FIG. 3 is a schematic cross sectional view of a new shock absorbing quad roller skate illustrating the spring absorption mechanism and brake system of the present invention.
Figure 4:
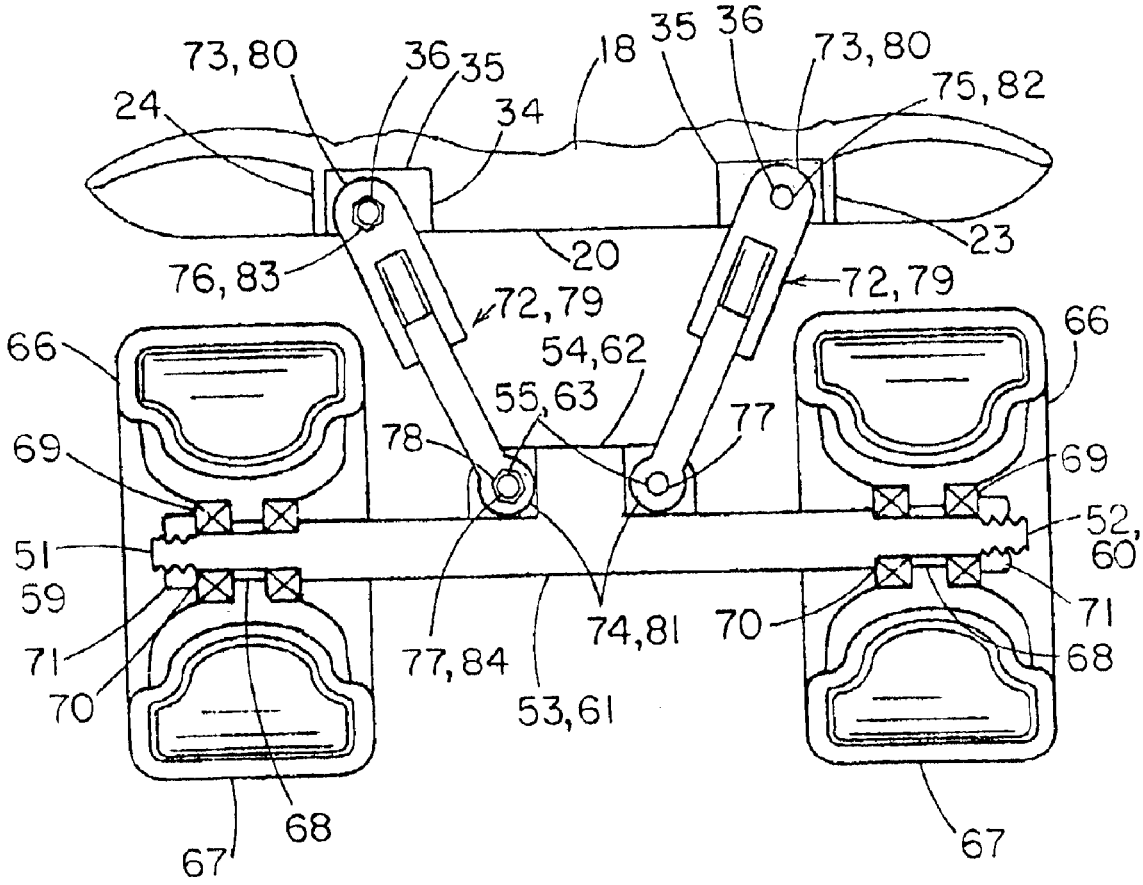
FIG. 4 is a schematic cross sectional view of a new shock absorbing quad roller skate illustrating how the front and back shock absorbers are connected according to the present invention.

With reference now to the drawings, and in particular to FIGS. 1 through 5 thereof, new shock absorbing quad and inline roller skates embodying the principles and concepts of the present invention will be described.

As best illustrated in FIGS. 1 through 4, the shock absorbing quad roller skates 10 generally comprises a boot 12 for fitting around a human foot. The boot 12 having a bottom side 13, a top side 14, an outer side 15 and an inner side 16. The boot 12 has a foam cushion lining 17 the inner side of the boot 12 for user comfort. A boot base 18 that is substantially the same length and width as the bottom side 13 of the boot 12 is coupled to the bottom side 13 of the boot 12. The boot base 18 has a top side 19, a bottom side 20, a front side 21, a back side 22, a first side 23 and a second side 24.

The bottom side 13 of the boot base 18 has a mid recess portion 25. The mid recess portion 25 forms a front side wall 26 proximate the front side 21 of the boot base 18. The mid recess portion 25 also forms a hack side wall 27 proximate the back side 22 of the boot base 18. Both the front side wall 26 and the back side wall 27 of the mid recess portion 25 are positioned perpendicular to the longitudinal axis of the boot base 18. The front side wall 26 has a threaded bore 28 that is aligned with the longitudinal axis of the boot base 18. The back side wall 27 has a threaded bore 29 that is aligned with the longitudinal axis of the boot base 18.

A front spring connecting protrusion 30 is coupled to the mid recess portion 25 of the boot base 18. The front spring connection protrusion 30 has a width and is positioned at a predetermined distance from the front side wall 26. The front spring connecting protrusion 30 is also positioned at a predetermined angle relative to the front side wall 26. The front connecting protrusion 30 has a bore 31 that is aligned with the threaded bore 28 in the front side wall 26.

A back spring connecting protrusion 32 is coupled to the mid recess portion 25 of the boot base 18. The back spring connecting protrusion 32 has a width and is positioned at a predetermined distance from the back side wall 27. The back spring connecting protrusion 32 is also positioned at a predetermined angle relative to the back side wall 27. In addition, the back connecting protrusion 32 has a bore 33 that is aligned with the threaded bore 27 in the back side wall 27.

The bottom side 20 of the boot base 18 has four shock recesses 34. One of the shock recesses 34 is positioned near the front side 21 and first side 23 of the boot base 18. Another of the shock recesses 34 is positioned near the front side 21 and second side 24 of the boot base 18. Another of the shock recesses 34 is positioned near the back side 22 and first side 23 of the boot base 18. The last of the shock recesses 34 is positioned near the back side 22 and second side 24 of the boot base 18. Each of the shock recesses 34 have a side wall 35 that is at a predetermined angle with respect to the bottom side 20 of the boot base 18. In addition, each of the side walls 35 have a threaded bore 36.

The boot base 18 has a pair of front fenders 37. One of the front fenders 37 protrudes out front the first side 23 of the boot base 18 proximate the boot base's 18 front side 21. The other one of the front fenders 37 protrudes out from the second side 24 of the boot base 18 proximate the boot base's 18 front side 21.

The boot base 18 has a pair of back fenders 38. One of the back fenders 38 protrudes out from the first side 23 of the boot base 18 proximate the boot base's 18 back side 22. The other one of the back fenders 38 protrudes out from the second side 24 of the boot base 18 proximate the boot base's 18 back side 22.

The boot base 18 also has a brake mount 39. The brake mount 39 has a first end 40 and a second end 41 and is cylindrical in shape. The first end 40 of the brake mount 39 has a threaded rod 42 extending therefrom along the longitudinal axis of the brake mount 39. The threaded rod 42 has a diameter. The second end 41 of the brake mount 39 is coupled to the bottom side 20 of the boot base 18 near the boot base's 18 front side 21. The brake mount 39 is coupled to the boot base 18 at a predetermined angle relative to the bottom side 20 of the boot base 18.

A brake 43 having a first end 44 and a second end 44 is coupled to the brake mount 39. The brake 43 is cylindrical in shape and is made of an elastomeric material. The first end 44 of the brake 43 has a cylindrical first well 46 with diameter slightly larger than the diameter of the brake mount 39. The second end 45 of the brake 43 has a second well 47 of a diameter. The wells 46, 47 in the first end 44 and second end 45 of the brake 43 have a connecting bore 48. The connecting bore 48 has a diameter slightly larger than the diameter of the threaded rod 42 on the brake mount 39. The first end 40 of the brake mount 39 is received in the first well 46 of the first end 44 of the brake 43. The threaded rod 42 on the brake mount 39 is received in the connecting bore 48 of the brake 43. The brake 43 is coupled to the brake mount 39 by a threaded nut 49 engaging the portion of the threaded rod 42 extending in the second well 47 of the brake 43.

The shock absorbing roller skates 10 have a front axle 50. The front axle 50 has a first end 51 a second end 52 and a middle section 53. The middle section 53 has a diameter. The first 51 and second 52 ends also have diameters but their diameters are less than the diameter of the middle section 53. The terminating portions of the first 51 and second 52 ends have threads. The middle section 53 of the front axle 50 has a first tab 54. The first tab 54 has two bores 55 therein. The middle section 53 of the front axle 50 also has a second tab 56. The second tab 56 is positioned at a predetermined angle with respect to the first tab 54. The second tab 56 has a bore 57 therein.

The shock absorbing roller skates 10 also have a back axle 58. The back axle 58 has a first end 59 and second end 60, and a middle section 61. The middle section 61 has a diameter. The first 59 and second 60 ends also have diameters hut their diameters are less than the diameter of the middle section 61. The terminating portions of the first 59 and second 60 ends have threads. The middle section 61 of the back axle 58 has a first tab 62. The first tab 62 has two bores 63 therein. The middle section 61 of the back axle 58 also has a second tab 64. The second tab 64 is positioned at a predetermined angle with respect to the first tab 62. The second tab 64 has a bore 65 therein.

The shock absorbing roller skates 10 have four wheels 66. Each of the wheels 66 has an outer inflatable tire portion 67 made of a puncture resistance material. Each of the wheels 66 also has a bore 68 through its center axis. The bores 68 in the wheels have diameters larger than the diameters of the ends of the front 50 and back 58 axles.

Each of the wheels 66 have a pair of bearings 69 with bores 70. The bores 70 in the bearings 69 have a diameter less than the diameter of the bores 68 in the wheels 66. The bores 70 in the bearings 69 have a diameter slightly greater than the diameter of the ends 51, 52, 59, 60 of the front 50 and back 58 axles but less than the diameter of the middle sections 53, 61 of the axles 50, 58. Each pair of bearings 69 is coupled to an associated one of the wheels 66. The bearings 69 are coupled to the wheels 66 in a manner such that each wheel 66 is positioned in between its associated bearings 69 and so that the bores 70 in the hearings 69 align with the bores 68 in the wheels 66. Each end 51, 52, 59, 60 of the front 50 and back 58 axles is received in the bores 70 of one of the pairs of bearings 69 and associated wheel 66. The wheels 66 are rotatably connected to the axles 50, 58 by four threaded nuts 71. The threaded nuts 71 engage the threads on the first 51, 59 and second 52, 60 ends of the axles 50, 58.

The shock absorbing roller skates 10 have a pair of front shock absorbers 72 for dampening motion. Each of the front shock absorbers 72 has a first end 73 and a second end 74. The first end 73 of each of the shock absorbers 72 has a bore 75. The bore 75 on the first end 73 of one of the front shock absorbers 10 is positioned so it is aligned with the threaded bore 36 in the side wall 35 of the shock recess 34 that is positioned near the front side 21 and first side 23 of the bottom side 22 of the boot base 18. The bore 75 on the first end 73 of the other front shock absorber 72 is positioned so it is aligned with the threaded bore 36 in the side wall 35 of the shock recess 34 that is positioned near the front side 21 and second side 24 of the bottom side 20 of the boot base 18. Threaded bolts 76 are inserted through the bores 75 in the first end 73 of the front shock absorbers 72 and are threadably connected to the threaded bores 36 in the shock recesses 34, thereby coupling the first end 73 of the front shock absorbers 72 to the boot base 18.

The second end of each front shock absorber 74 has a bore 77. The bore 77 on the second end 74 of one of the front shock absorbers 72 is positioned so it is in align with one of the bores 55 on the first tab 54 of the front axle 50. The bore 77 on the second end 74 of the other front shock absorber 72 is positioned so it is in align with the other bore 55 on the first tab 54 of the front axle 50. A pair of bolts 78 are inserted through the bores 77, 55 coupling the second end 74 of the front shock absorbers 72 to the front axle 50.

The shock absorbing roller skates 10 also have a pair of back shock absorbers 79. Each of the back shock absorbers 79 has a first end 80 and a second end 81. The first end 80 of each back shock absorber 79 has a bore 82. The bore 82 on the first end 88 of one of the back shock absorbers 79 is positioned so it is aligned with the threaded bore 36 in the side wall 35 of the shock recess 34 that is positioned near the hack side 22 and first side 23 of the bottom side 20 of the boot base 18. The bore 82 on the first end 80 of the other back shock absorber 79 is positioned so it aligned with the threaded bore 36 in the side wall 35 of the shock recess 34 that is positioned near the back side 22 and second side 24 of the bottom side 20 of the boot base 18. A pair of threaded bolts 83 are inserted through the bores 82 in the first end 80 of the back shock absorbers 79 and are threadably engaged with the threaded bores 36 in the shock recesses 34, thereby coupling the first end 80 of the back shock absorbers 79 to the boot base 18.

The second ends 81 of each of the back shock absorbers 79 have a bore 84. The bore 84 on the second end 81 of one of the back shock absorbers 79 is positioned so it is in align with one of the bores 63 on the first tab 62 of the back axle 53. The bore 84 on the second end 81 of the other back shock absorber 79 is positioned so it is in align with the other bore 63 on the first tab 62 of the back axle 58. A pair of bolts 78 are inserted through the bores 84, 63 coupling the second end 81 of the back shock absorbers 79 to the back axle 58.

The shock absorbing roller skates 10 have a pair of spring absorption mechanisms 85. Each of the spring absorption mechanisms 85 has an upper shaft 86. The upper shafts 86 have a first end 88 and a second end 89. The first ends 88 of each upper shall 86 have a channel 90 and a pair of bores 91. The bores 91 are axially aligned with each other across the channels 90. The distance across each channel 90 is slightly greater than the width of the spring connecting protrusions 30, 32 on the bottom side 20 of the boot base 18. The second ends 89 of the upper shaft 86 each have a well 92.

Each of the spring absorption mechanisms 85 have a lower shaft 87. Each lower shaft 87 has a first end 93 and a second end 94. The first end 93 of each lower shaft 87 has a diameter slightly less than the diameter of the wells 92 in the second ends 89 of the upper shafts 86. Each one of the first ends 93 of the lower shaft 87 is received in the wells 92 of the second end 89 of an associated one of the tipper shafts 86. The lower shafts 87 are free to slide in and out of the wells 92 in the upper shafts 86. The second ends 94 of the lower shafts 87 terminate in threads.

Each spring absorption mechanism 85 also has a helical spring 95 coiled around the upper 86 and lower 87 shafts for biasing the upper 86 and lower 87 shafts away from each other.

The spring absorption mechanisms 85 each have a pair of rubber bushings 96 with bores and a pair of washers 97 with bores. The second tab 56 of the front axle 50 is placed in between one pair of the rubber bushings 96 in a manner such that the bores on the rubber bushings 96 align with the bore 57 in the second tab 56 of the front axle 50. The second tab 64 of the back axle 58 is place in between the other pair of rubber bushings 96 in a manner such that the bores of the rubber bushings 96 align with the bore 65 in the second tab 64 of the back axle 58. The washers 97 are positioned adjacent to the rubber bushings 96 in a manner such that the bores of the washers align with the bores of the rubber bushings and the bores 57, 65 of the second tabs 56, 64.

The second end 94 of the lower shaft 87 of the one of the spring absorption mechanisms 85 is received through the bore 57 in the second tab 56 of the front axle 50 and the bores in the associated washers 97 and rubber bushings 96. A threaded nut 98 threadably engages the threads on the second end 94 of the lower shaft 87 coupling the lower shaft 87 of the spring absorption mechanism 85 to the front axle 50.

The channel 90 in the first end 88 of the upper shaft 86 of the spring absorption mechanism 85 that is coupled to the front axle 50 is received around the front spring connecting protrusion 30 on the bottom side 20 of the boot base 18. The bore 31 on the front spring connecting protrusion 30 is aligned with the bores 91 in the upper shaft 86 of the spring absorption mechanism 85 and the threaded bore 28 in the front side wall 26 formed by the mid recess portion 25 in the bottom side 20 of the boot base 18. A threaded hex head fastener 99 is inserted through the bores 31, 91 and threadably engages the threads in the threaded bore 28 in the front side wall 26. The upper shaft 86 of the spring absorption mechanism 85 is thereby coupled to the boot base (see FIG. 3).

The second end 44 of the lower shaft 87 of the other of the spring absorption mechanisms 85 is received through the bore 65 in the second tab 64 of the back axle 58 and the bores in the associated washers 97 and rubber bushings 96. A threaded nut 98 threadably engages the threads on the second end 94 of the lower shaft 97 coupling the lower shaft 87 of the spring absorption mechanism 85 to the back axle 58.

The channel 90 in the first end 88 of the upper shaft 86 of the spring absorption mechanism 85 that is coupled to the back axle 58 is received around the back spring connecting protrusion 32 on the bottom side 20 of the boot base 18. The bore 33 on the back spring connecting protrusion 32 is aligned with the bores 91 in the upper shaft 86 of the spring absorption mechanism 85 and the threaded bole 29 in the back side wall 27 formed by the mid recess portion 25 in the bottom side 20 of the boot base 18. A threaded hex head fastener 99 is inserted through the bores 33, 91 and threadably engages the threads in the threaded bore 29 in the back side wall 27. The upper shaft 86 of the spring absorption mechanism 85 is thereby coupled to the boot base 18.

Figure 5:
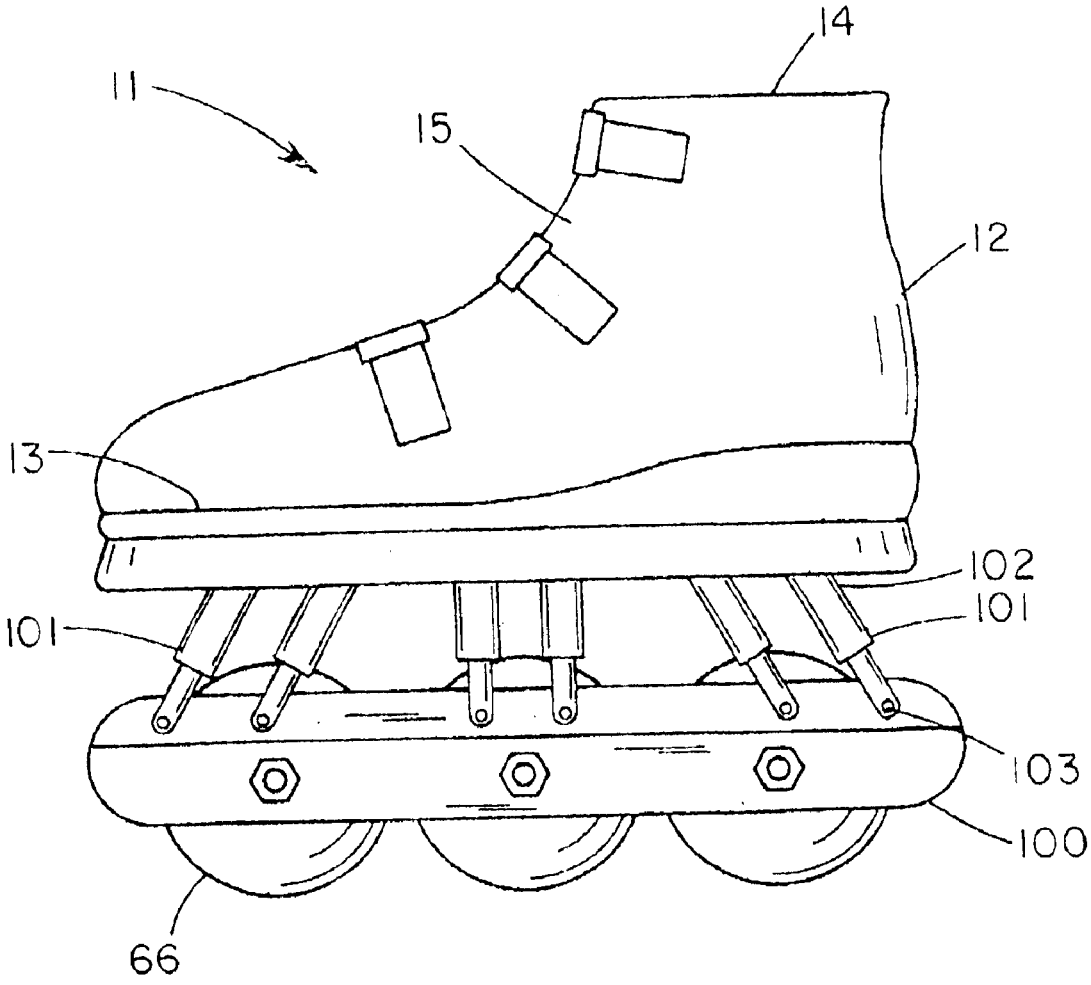
FIG. 5 is a schematic side view of a new shock absorbing inline roller skate according to the present invention.

In addition, to the above-described shock absorbing roller skates 10, a shock absorbing inline roller skate 11 is also claimed (see FIG. 5). The wheels 66 are positioned in a straight line by a plate 100. The plate 100 is adapted to rotatably couple a plurality of wheels 66 in an inline configuration.

The shock absorbing inline roller skate 11 has a plurality of shock absorbers 101. Each of the shock absorbers have a first end 102 and a second end 103. The first end 102 of each shock absorber 101 is coupled to the bottom side 20 of the boot base 18. The second end 103 of each shock absorber 101 is coupled to the plate 100.

In use, the user simply puts the boots 12 on his or her feet and proceeds to skate.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shock absorbing roller skate comprising:

a boot for fitting around a human foot, the boot having a bottom side, a top side, an outer side and an inner side;

a foam cushion for user comfort, the foam cushion lining the inner side of the boot;

a boot base being substantially the same length and width as the bottom side of the boot, the boot base having a top side, a bottom side, a front side, a back side, a first side and a second side, the bottom side of the boot being coupled to the top side of the boot base;

the bottom side of the boot base having a mid recess portion, the mid recess portion forming a front side wall proximate the front side of the boot base and forming a back side wall proximate the back side of the boot base, both the front side wall and the back side wall of the mid recess portion being perpendicular to the longitudinal axis of the boot base, the front side wall having a threaded bore that is aligned with the longitudinal axis of the boot base, the back side wall having a threaded bore that is aligned with the longitudinal axis of the boot base;

a front spring connecting protrusion having a width, the front spring connecting protrusion being coupled to the mid recess portion of the boot base at a predetermined distance from the front side wall, the front spring connecting protrusion being positioned at a predetermined angle relative to the front side wall, the front connecting protrusion having a bore that is aligned with the threaded bore in the front side wall;

a back spring connecting protrusion having a width, the back spring connecting protrusion being coupled to the mid recess portion of the boot base at a predetermined distance from the back side wall, the back spring connecting protrusion being positioned at a predetermined angle relative to the back side wall, the back connecting protrusion having a bore that is aligned with the threaded bore in the back side wall;

the bottom side of the boot base having four shock recesses, one of the shock recesses being positioned near the front side and first side of the boot base, another of the shock recesses being positioned near the front side and second side of the boot base, another of the shock recesses being positioned near the back side and first side of the boot base, the last of the shock recesses being positioned near the back side and second side of the boot base, each of the shock recesses having a side wall that is at a predetermined angle with respect to the bottom side of the boot base, each of the side walls having a threaded bore;

the boot base having a pair of front fenders, one of the front fenders protruding out from the first side of the boot base proximate the boot base's front side, the other one of the front fenders protruding out from the second side of the boot base proximate the boot base's front side;

the boot base having a pair of back fenders, one of the back fenders protruding out from the first side of the boot base proximate the boot base's back side, the other one of the back fenders protruding out from the second side of the boot base-proximate the boot base's back side;

a brake mount having a first end and a second end, the brake mount being cylindrical in shape, the first end of the brake mount having a threaded rod extending therefrom along the longitudinal axis of the brake mount, the threaded rod having a diameter, the second end of the brake mount being coupled to the bottom of the boot base near the boot base's front side and extending at a predetermined angle relative to the bottom side of the boot base;

a brake having a first end and a second end, the brake being cylindrical in shape and being made of an elastomeric material, the first end of the brake having a cylindrical first well with diameter slightly larger than the diameter of the brake mount, the second end of the brake having a second well of a diameter, the wells in the first end and second end of the brake having a connecting bore, the connecting bore having a diameter slightly larger than the diameter of the threaded rod on the brake mount, the first end of brake mount being received in the first well of the first end of the brake, the threaded rod on the brake mount being received in the connecting bore of the brake, wherein the brake is coupled to the brake mount by a threaded nut engaging the portion of the threaded rod extending in the second well of the brake;

a front axle having a first end, a second end and a middle section, the middle section having a diameter, the first and second ends having a diameter less-than the diameter of the middle section, the terminating portions of the first and second ends having threads, the middle section of the front axle having a first tab, the first tab having two bores therein, the middle section of the front axle also having a second tab, the second tab being positioned at a predetermined angle with respect to the first tab, the second tab having a bore therein;

a back axle having a first end and second end, and a middle section, the middle section having a diameter, the first and second ends having a diameter less than the diameter of the middle section, the terminating portions of the first and second ends having threads, the middle section of the back axle having a first tab, the first tab having two bores therein, the middle section of the back axle also having a second tab, the second tab being positioned at a predetermined angle with respect to the first tab, the second tab having a bore therein;

four wheels each having a diameter, each of the wheels having an outer inflatable tire portion, the outer tire portion being made of puncture resistance material, each of the wheels having a bore through their center axis, each bore having a diameter larger than the diameter of the ends of the front and back axles;

each of the wheels having a pair of bearings, each of the bearings having a bore, the bores in the bearings having a diameter less than the diameter of the bores in the wheels, the bores in the bearings having a diameter slightly more than the diameter of the ends of the front and back axles but less than the diameter of the middle sections of the axles, each pair of bearings being coupled to an associated one of the wheels in a manner such that each wheel is positioned in between its associated bearings and so that the bores in the bearings align with the bores in the wheels, each end of the front and back axles are received in the bores of one of the pairs of bearings and associated wheel, four breaded nuts threadably engage the threads on the first and second ends of the axles, wherein the wheels are rotatably connecting to the axles;

a pair of front shock absorbers for dampening motion, each of the front shock absorbers having a first end and a second end, the first end of each of the shock absorbers having a bore, the bore on the first end of one of the front shock absorbers being positioned so it is aligned with the threaded bore in the side wall of the shock recess that is positioned near the front side and first side of the bottom of the boot base, the bore on the first end of the other front shock absorber being positioned so it is aligned with that threaded bore in the side wall of the shock recess that is positioned near the front side and second side of the bottom of the boot base, a pair of threaded bolts are inserted through the bores in the first end of the front shock absorbers and threadably engage the threaded bores in the shock recesses, wherein the first end of the front shock absorbers are coupled to the boot base;

the second end of the front shock absorbers each having a bore, the bore on the second end of one of the front shock absorbers being positioned so it is in align with one of the bores on the first tab of the front axle, the bore on the second end of the other front shock absorber being positioned so it is in align with the other bore on the first tab of the front axle, a pair of bolts are inserted through the bores, wherein the second end of the front shock absorbers are coupled to the front axle;

a pair of back shock absorbers for dampening motion, each of the back shock absorbers having a first end and a second end, the first end of each back shock absorbers having a bore, the bore on the first end of one of the back shock absorbers being positioned so it is aligned with the threaded bore in the side wall of the shock recess that is positioned near the back side and first side of the bottom side of the boot base, the bore on the first end of the other back shock absorber being positioned so it aligned with the threaded bore in the side wall of the shock recess that is positioned near the back side and second side of the bottom side of the boot base, a pair of bolts are inserted through the bores in the first end of the back shock absorbers and threadably engage the threaded bores in the shock recesses, wherein the first end of the back shock absorbers are coupled to the boot base;

the second end of the back shock absorbers each having a bore, the bore on the second end of one of the back shock absorbers being positioned so it is in align with one of the bores on the first tab of the back axle, the bore on the second end of the other back shock absorber being positioned so it is in align with the other bore on the first tab of the back axle, a pair of bolts are inserted through the bores, wherein the second end of the back shock absorbers are coupled to the back axle;

a pair of spring absorption mechanisms, each of the spring absorption mechanisms having an upper shaft, each of the upper shafts having a first end and a second end, each of the first ends having a channel and a pair of bores, the bores being axially aligned with each other across the channels, the distance across the channels being slightly greater than the width of the spring connecting protrusions on the bottom side of the boot base, the second ends of the upper shaft each having a well;

each of the spring absorption mechanisms having a lower shaft, each lower shaft having a first end and a second end, each of the first ends having a diameter slightly less than the diameter of the wells in the second ends of the upper shafts, each one of the first ends of the lower shaft being received in the wells of the second end of fat associated one of the upper shafts, wherein the lower shafts are free to slide in and out of the wells in the upper shafts, the second ends of the lower shafts terminating it threads;

each spring absorption mechanism also having a helical spring coiled around the upper and lower shafts for biasing the upper and lower shafts away from each other;

each spring absorption mechanism having a pair of rubber bushings having bores and a pair of washers having bores, the second tab of the front axle being placed in between one pair of the rubber bushings in a manner such that the bores on the rubber bushings align with the bore in the second tab of the front axle, the second tab of the back axle being place in between the other pair of rubber bushings in a manner such that the bores of the rubber bushings align with the bore in the second tab of the back axle, the washers being positioned adjacent to the rubber bushings in a manner such that the bores of the washers align with the bores of the rubber bushings and the bores of the second tabs;

the second end of the lower shaft of the one of the spring absorption mechanisms being received through the bore in the second tab of the front axle and the bores in the associated washers and rubber bushings, wherein a nut threadably engages the threads on the second end of the lower shaft coupling the lower shaft of the spring absorption mechanism to the front axle;

the channel in the first end of the upper shaft of the spring absorption mechanism that is coupled to the front axle receiving the front spring connecting protrusion on the bottom side of the boot base in a manner such that the bore on the front spring connecting protrusion is aligned with the bores in the upper shaft of the spring absorption mechanism and the threaded bore in the front side wall formed by the mid recess portion in the bottom side of the boot base, wherein a threaded hex head fastener is inserted through the bores and threadably engages the threads in the threaded bore in the front side wall of the bottom of the boot base coupling the upper shaft of the spring absorption mechanism to the boot base;

the second end of the lower shaft of the other of the spring absorption mechanisms being received through the bore in the second tab of the back axle and the bores in the associated washers and rubber bushings, wherein a nut threadably engages the threads on the second end of the lower shaft coupling the lower shaft of the spring absorption mechanism to the back axle; and the channel in the first end of the upper shaft of the spring absorption mechanism that is coupled to the back axle receiving the back spring connecting protrusion on the bottom of the boot base in a manner such that the bore on the back spring connecting protrusion is aligned with the bores in the upper shaft of the spring absorption mechanism and the threaded bore in the back side wall formed by the mid recess portion in the bottom side of the boot base, wherein a threaded hex head fastener is inserted through the bores and threadably engages the threads in the threaded bore in the back side wall of the bottom of the boot base coupling the upper shaft of the spring absorption mechanism to the boot base.

* * * * *